US005649763A

United States Patent [19]

Liou

[11] Patent Number: 5,649,763

[45] Date of Patent: Jul. 22, 1997

[54] DECORATIVE LAMP STRUCTURE

[76] Inventor: Ching-Chong Liou, P.O. Box 96-405, Taipei 10098, Taiwan

[21] Appl. No.: 574,904

[22] Filed: Dec. 19, 1995

[51] Int. Cl.[6] ..... F21P 1/02

[52] U.S. Cl. ..... 362/363; 362/806

[58] Field of Search ..... 362/363, 806

[56] References Cited

U.S. PATENT DOCUMENTS 5,414,605 5/1995 Lih ..... 362/267

*Primary Examiner*—Carroll B. Dority

[57] ABSTRACT

An improved decorative lamp structure, which has a shell socket with inner threads on the inner surface thereof so as to engage with a shell portion for decoration purpose; the other end of the shell socket has a cylindrical part, of which the outer surface is furnished with symmetrical vertical channels; between the vertical channel and the cylindrical hole, there is an even thickness and width so as to let at least one power wire pass through. A portion of the cylindrical surface without vertical channel is furnished with a round groove. The center of the cylindrical part has a cylindrical hole for receiving the socket housing, of which one end has a socket to be plugged with a decorative lamp. The socket housing extends into the center of the shell portion. The inner surface of a cap is furnished with a fluke ring to be engaged with a round groove on the cylindrical surface after the cap being pressed on the cylindrical part of the shell socket so as to prevent the cap and the shell socket from being separated unintentionally.

4 Claims, 3 Drawing Sheets

DECORATIVE LAMP STRUCTURE

BACKGROUND OF THE INVENTION

1. This invention relates to a decorative lamp, and particularly to a decorative lamp with an elongate cylinder portion, which is to be mounted in a decorative shell portion. mounted in a decorative shell portion.

2. Description of the Prior Art

In the conventional decorative lamp string for Christmas, the two wires of a small bulb usually pass through a hole in the socket thereof; then, the two wires will be bent and mounted on two side walls in a seat; a socket to mount the seat has two copper contactors fixed therein. After a small bulb is plugged in the socket, the two wires bent will be in contact with the two copper contactors respectively; then, the socket will be connected with the power wires into a string.

In the conventional lamp string for Christmas season, the decorative lamp is plugged directly to a decorative shell so as to have a better decoration effect; the lamp and the decorative shell will put on a Christmas tree; however, since the decorative shell and the lamp are not connected firmly together, they are subject to being separated from each other.

In the conventional lamp structure for Christmas decoration, a U.S. Pat. No. 5,414,605 has disclosed that, wherein the lamp holder has a vertical cylinder housing and a lamp seat, the cylinder housing is made of an insulating material and has an open top and bottom wall, the lamp seat is mounted securely on the bottom wall of the cylindrical housing and a wire passage formed there through so as to define an annular groove between the lamp seat and the cylindrical housing. The transport lampshade covers the lamp and has annular on the lamp seat under the inward flange of the cylindrical rubber seal. The outward flange of the lampshade has an outer diameter which is slightly greater than the inner diameter of the inward flange can be pushed or pulled forcibly to extend through the inward flange of the rubber seal.

SUMMARY OF THE INVENTION

The prime object of the present invention is to provide a decorative lamp structure, in which the inside of the shell socket is furnished with inner threads to be engaged with the threads of a shell portion; one end of the shell socket has a cylindrical part, of which the center has a cylindrical hole for receiving an elongate socket housing. One end of the socket housing has a socket for receiving a decorative lamp, which can extend into the center of a shell portion. The upper end of the cylindrical part of the shell socket is to be covered with a cap so as to have the socket housing and the shell socket connected together.

Another object of the present invention is to provide a decorative lamp structure, in which two symmetrical sides of the cylindrical part of the shell socket are provided with two vertical channels respectively; each of the vertical channels has a suitable depth and width. Between the vertical channel and the cylindrical hole, there is an even thick wall. The part of the cylindrical surface 37 without having the vertical channel is furnished with a round groove, which is to be engaged with the fluke ring of the cap upon the cap being mounted on the shell socket. The power wires pulled out of the guide hole of the socket housing will pass through the vertical channel.

Still another object of the present invention is to provide a decorative lamp structure, in which the center of the cylindrical part on the shell socket has a cylindrical hole for receiving the socket housing. The power wires pulled out of the guide hole will pass through the vertical channel; the power wires will be fastened in place after the cap being put over the cylindrical part because the guide channel of the cap becoming engaged with the vertical channel.

A further object of the present invention is to provide a decorative lamp structure, in which the cylindrical part of the shell socket has vertical channels having a suitable width and depth for receiving several power wires to be pulled out.

DETAILED DESCRIPTION OF THE PREFERRED EMBODIMENT

Figure 1:
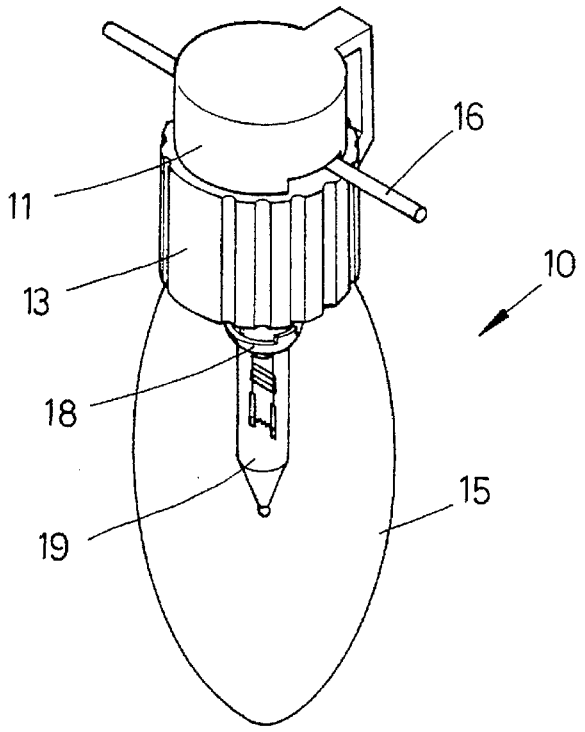
FIG. 1 is a perspective view of an embodiment-1 according to the present invention.
Figure 2:
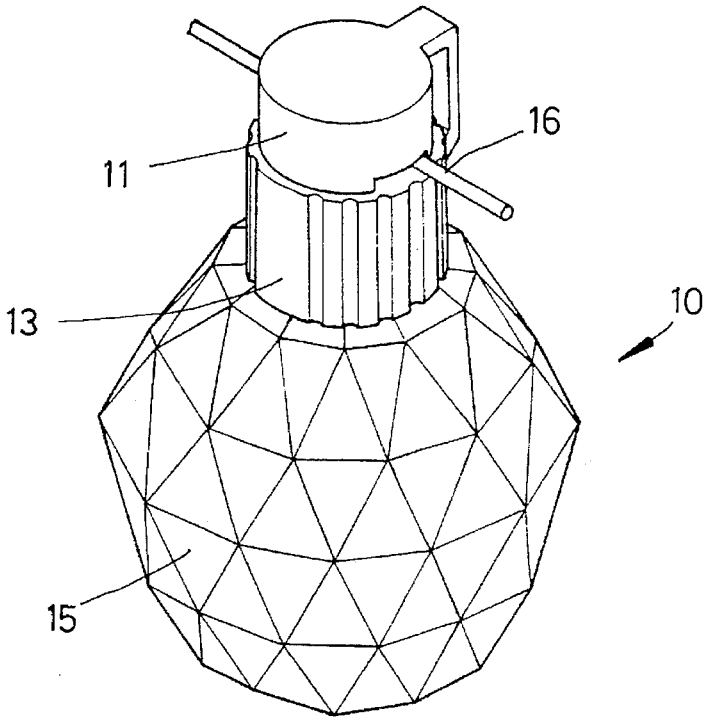
FIG. 2 is a perspective view of an embodiment-2 according to the present invention.
Figure 3:
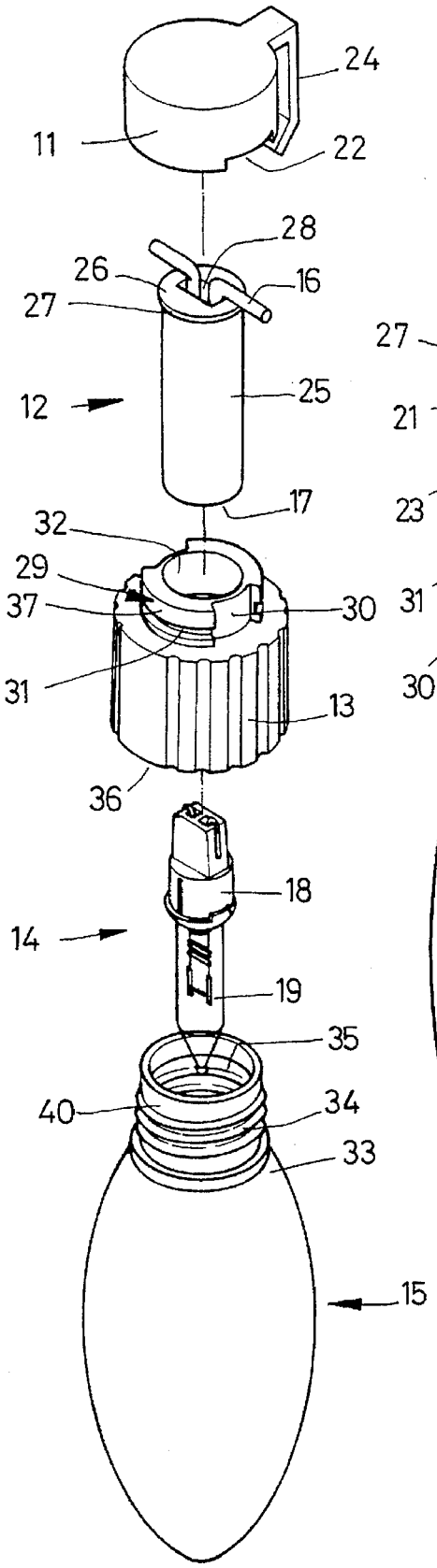
FIG. 3 is a disassembled view of the present invention, showing a fragmental section view thereof.
Figure 4:
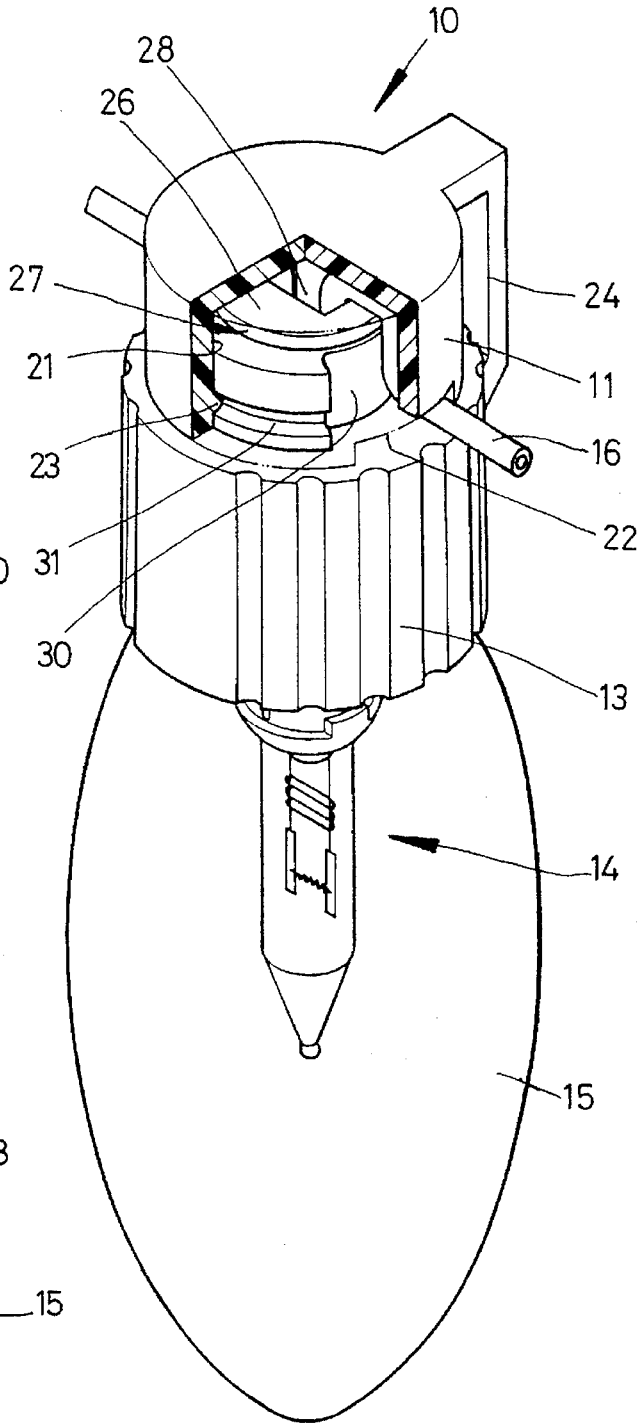
FIG. 4 is a fragmental section view of the present invention.
Figure 5:
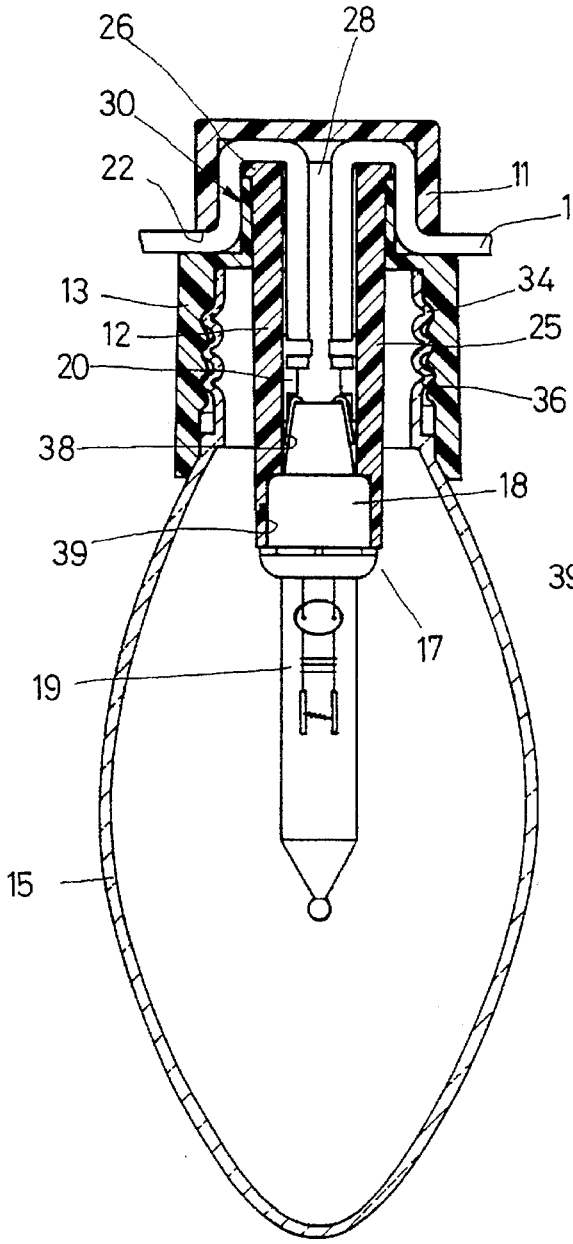
FIG. 5 is a longitudinal section view-1 of the present invention.
Figure 6:
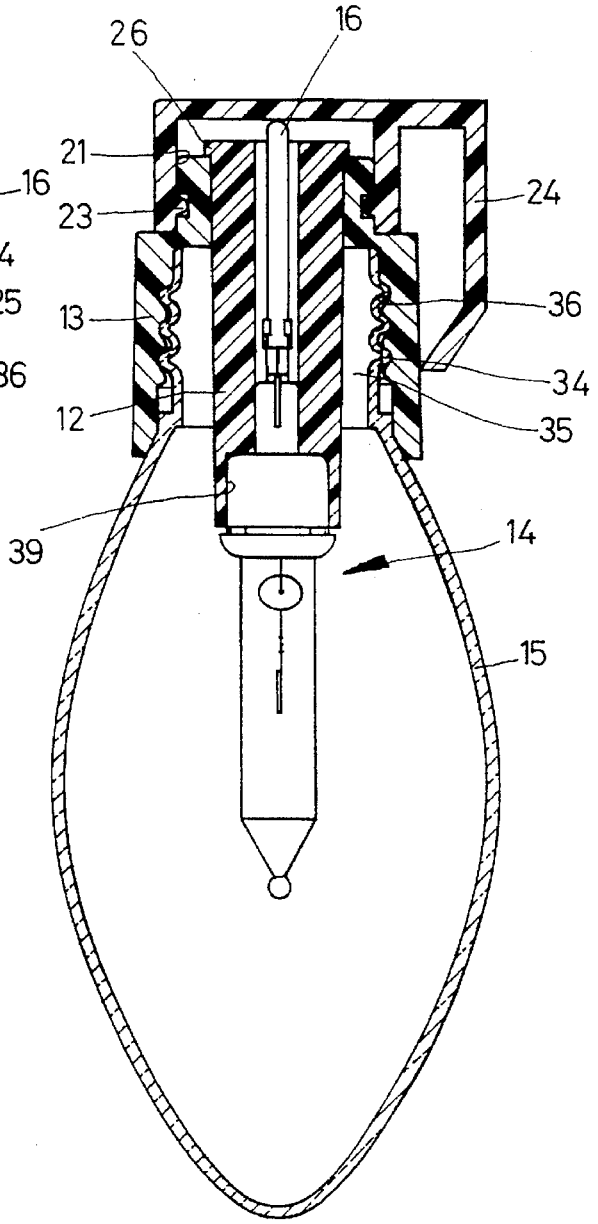
FIG. 6 is a longitudinal section view-2 of the present invention.

This invention relates to a decorative lamp structure. As shown in FIGS. 1 and 2, the lower part of the shell socket 13 is mounted with a lamp shell 15, being similar to a bulb. The lamp shell 15 is also designed into a polygonal shell, or other suitable shapes.

Referring to FIGS. 3 to 6, the decorative lamp 10 comprises a cap 11, a socket housing 12, a shell socket 13, a decorative lamp 14, a lamp shell 15, power wires 16 and copper contactors 20. The inner surface of the shell socket 13 is furnished with inner threads 36 for fastening the lamp shell in place. The center of the shell socket 13 has a cylindrical hole 32 for mounting the socket housing 12 therein. The decorative lamp 14 is to be plugged in the socket 17 of the socket housing 12; the other end of the socket housing 12 has a guide hole 28 for the power wires 16 to pull out. The socket housing 12 is to be inserted into the cylindrical hole 32 of the cylindrical part 29. The power wires 16 are to be pulled out along the vertical channel 30 outside the cylindrical part 29 of the shell socket 13. After the cap 11 is mounted in place, the hook will also be put in place.

The shell socket 13 of the decorative lamp 10 is provided with a suitable outer form. The upper part of the shell socket 13 has a cylindrical part 29, of which the center has a cylindrical hole 32; the other end of the shell socket 13 has a suitable depth and space furnished with inner threads 36 to be engaged with the outer threads 34 of the lamp shell 15. The cylindrical hole 32 in the center of the cylindrical part 29 is used for mounting the cylinder portion 25 of the socket housing 12, and the hole 32 has a suitable depth so as to fasten the socket housing 12 in place. The cylindrical surface 37 on the cylindrical part 29 has a round groove 31, and both sides of the cylindrical surface 37 are provided with two symmetrical vertical channels 30 having a given depth and width. The depth of the vertical channel 30 is equal to or slightly less than the diameter of the power wire 16, and the width thereof can at least receive more than one power wire 16. The thickness between the vertical channel 30 and the cylindrical hole 32 is even and thick enough so as to withstand the pulling force of the power wires 16 pulled out of the guide hole 28 and along the vertical channels 30.

The inner surface of the shell socket 13 is furnished with inner threads 36 to be engaged with the outer threads 34 of the round surface 40 of the lamp shell 15. The center of the round surface 40 has a cylindrical hole 35, of which the diameter is larger than that of the cylinder portion 25 of the socket housing 12. The neck portion 33 of the lamp shell 15 extends downwards to form into a shell portion. The outer threads 34 of the round surface 40 of the lamp shell 15 is to be engaged with the inner threads 36 in the inner surface of the shell socket 13. In case of the bulb 19 of the decorative lamp 14 being broken, it can be replaced with a new one after the lamp shell 15 being disassembled.

One end of the cylinder portion 25 of the socket housing 12 has a socket 17, while the other end thereof has a round top 26; the inside of lower end of the socket 17 of the socket housing 12 has a channel surface 38 for mounting two copper contactors 20 on both sides thereof. The lowest part of the lower end is furnished with a socket inner surface 39 for mounting a decorative lamp 14. Above the channel surface 38, there is a guide hole 28 to facilitate the power wires 16 to pull out. After a decorative lamp 14 is plugged into the socket 17, two wires of the bulb 19 will be in close contact with the two copper contactors 20 respectively; the bulb socket 18 is to be mounted on the socket inner surface 39 of the socket 17. The socket housing 12 has an elongate cylinder portion 25, of which the upper end has a round top 26; the diameter of the cylinder portion 25 is equal to or slightly less than that of the cylindrical hole 32 of the shell socket 13; the diameter of the round top 26 is larger than that of the cylindrical hole 32, but less than that of the vertical channel 30. After the socket housing 12 is plugged into the cylindrical hole 32 of the shell socket 13, the flange 27 between the cylinder portion 25 and the round top 26 will be stopped on the opening of the cylindrical hole 32 of the cylindrical part 29 on the shell socket 13.

The cap 11 to be mounted on the cylindrical part 29 has a deep internal surface 21 therein; the diameter of the internal surface 21 is equal to or slightly larger than that of the cylindrical part 29. Both sides of the opening of the cap 11 are furnished with two symmetrical guide channels 22, while the inner surface of the cap having no guide channel is provided with a fluke ring 23, which will be engaged with the round groove 31 on the cylindrical surface 37 upon the cap 11 mounting on the cylindrical part 29 of the shell socket 13 so as to prevent the cap 11 from being separated from the shell socket 13. The opening of the cap 11 has two symmetrical guide channels 22 with a suitable depth so as to facilitate power wires 16 to pull out after the cap 11 being mounted on the shell socket 13.

The shell socket 13 and the shell portion 15 may be assembled together before or after the socket housing 12 and the shell socket 13 being assembled together. The socket 17 of the socket housing 12 is used for mounting the decorative lamp 14; the power wires 16 are to be pulled out of the other end thereof. The cylinder portion 25 of the socket housing 12 is to be plugged into the cylindrical hole 32 of the shell socket 13; the flange 27 is to be stopped on the opening of the cylindrical hone 32. The decorative lamp 14 plugged into the socket 17 of the socket housing 12 is located outside of the internal surface 21 of the shell socket 13. If the shell portion 15 is mounted in the internal surface of the shell socket 13 first, the decorative lamp 14 will be located in the central part in the shell portion 15. The power wires 16 may be pulled out of the guide hole 28 of the socket housing 12 in two different methods, of which the first method is to have the two power wires 16 pulled out oppositely thorough the two vertical channels 30 on both sides of the cylindrical hole 32 respectively, while the second method is to have the two power wires 16 or more than two wires pulled out through the vertical channel 30 and pressed in place by means of the symmetrical guide channels 22 of the cap 11 after the cap 11 being mounted to the cylindrical part 29. After the cap 11 is mounted in place, the fluke ring 23 on the internal surface 21 will be engaged with the round groove 31 on the cylindrical surface 37 of the cylindrical part 29 so as to prevent the cap 11 and the shell socket 13 from separated unintentionally, and to have the socket housing 12 fixed in place. In case of the decorative lamp 14 being damaged, the shell portion 15 may be separated from the shell socket 13 so as to replace the decorative lamp 14.

The embodiment of the present invention has been described in detail to disclose the features and structure thereof; it is apparent that the present invention has shown the improvement thereof, which is never anticipated and accomplished by others so far; the structure of the present invention is deemed unique.

I claim:

1. An improved decorative lamp structure comprising:

a shell socket, including one end having an inner surface with inner threads, and another end thereof having a cylindrical part, of which an outer surface has two symmetrical vertical channels and a round groove; said cylindrical part having a cylindrical hole in it center;

a socket housing having an elongate cylinder portion with one end having a socket, and a channel surface of said socket mounted with two copper contactors; the other end of said cylinder portion having a guide hole; power wires to be in contact with said copper contactors extended out of said guide hole; said other end of said cylinder portion having a round top;

a decorative lamp including a bulb socket and a bulb; said bulb socket to be plugged to a socket housing inner surface of said socket housing; copper wires on both sides of said bulb socket to be in contact with said two copper contactors respectively;

a shell portion to provide a decorative function; one end of said shell portion having a round surface with outer threads; a center of said round surface having a cylindrical hole; said outer threads to be engaged with said inner threads in said shell socket; said cylindrical hole for receiving said cylinder portion of said socket housing; and a cap having an internal surface, and two symmetrical guide channels; said internal surface having no guide channel being furnished with a fluke ring.

2. An improved decorative lamp structure as claimed in claim 1, wherein said cylindrical part of said shell socket with said two symmetrical vertical channels is adapted to let at least one power wire pass through to be pulled out after said cap has been mounted in place.

3. An improved decorative lamp structure as claimed in claim 1, wherein a cylindrical surface of said cylindrical part of said shell socket is furnished with symmetrical round groove; said internal surface of said cap having no guide channel being furnished with a fluke ring; said cap to be mounted over said cylindrical surface of said cylindrical part of said shell socket; upon being pressed, said fluke ring of said cap being engaged with said round groove of said shell socket.

4. An improved decorative lamp structure as claimed in claim 1, wherein an upper end of said elongate cylinder portion of said socket housing is furnished with a round top, having a diameter larger than that of said cylindrical hole, but being less than that of said symmetrical vertical channel; said round top and said cylinder portion formed into a flange; after said socket housing plugged into said cylindrical hole of said shell socket, said flange is positioned on the opening of said cylindrical hole of said cylindrical part of said shell socket.

* * * * *